US010971863B1

(12) United States Patent
Wu et al.

(10) Patent No.: US 10,971,863 B1
(45) Date of Patent: Apr. 6, 2021

(54) HIGH SPEED CONNECTOR ASSEMBLY AND ELECTRICAL CONNECTOR THEREOF

(71) Applicant: Greenconn Corp., New Taipei (TW)

(72) Inventors: Kun-Shen Wu, New Taipei (TW); Jiun-Fu Ke, New Taipei (TW)

(73) Assignee: Greenconn Corp., New Taipei (TW)

( * ) Notice: Subject to any disclaimer, the term of this patent is extended or adjusted under 35 U.S.C. 154(b) by 2 days.

(21) Appl. No.: 16/581,759

(22) Filed: Sep. 25, 2019

(51) Int. Cl.

| | |
|---|---|
| ***H01R 13/66*** | (2006.01) |
| ***H01R 13/6585*** | (2011.01) |
| ***H01R 13/115*** | (2006.01) |
| ***H01R 13/646*** | (2011.01) |
| *H01R 107/00* | (2006.01) |

(52) U.S. Cl.
CPC ..... *H01R 13/6585* (2013.01); *H01R 13/115* (2013.01); *H01R 13/646* (2013.01); *H01R 2107/00* (2013.01)

(58) Field of Classification Search
CPC .. H01R 23/7068; H01R 23/7073; H01R 4/64; H01R 23/688
USPC ... 439/60, 79, 92, 101, 108, 607.05, 607.08, 439/636, 637, 660
See application file for complete search history.

(56) References Cited

U.S. PATENT DOCUMENTS 4,087,151 A * 5/1978 Robert ..... H01R 23/70 200/51.1
5,098,306 A * 3/1992 Noschese ..... H01R 12/721 439/188
5,190,480 A * 3/1993 Chau ..... H01R 13/26 439/567
5,496,180 A * 3/1996 Fabian ..... H01R 4/028 439/60
5,676,559 A * 10/1997 Laub ..... H01R 12/62 439/260
5,725,389 A * 3/1998 Scheer ..... H01R 12/721 439/328
5,971,809 A * 10/1999 Ho ..... H01R 13/20 439/660

(Continued)

FOREIGN PATENT DOCUMENTS

| | | |
|---|---|---|
| TW | M509991 U | 10/2015 |
| TW | M542261 U | 5/2017 |
| TW | M589380 U | 1/2020 |

*Primary Examiner* — Thanh Tam T Le
(74) *Attorney, Agent, or Firm* — Li & Cai Intellectual Property Office

(57) ABSTRACT

A high speed connector assembly and an electrical connector thereof are provided. The electrical connector includes an insulating housing and a plurality of signal terminals fixed in the insulating housing. The insulating housing is in an elongated shape defining a longitudinal direction, and defines an insertion direction perpendicular to the longitudinal direction. The signal terminals are arranged in two rows each parallel to the longitudinal direction, and the signal terminals in one of the two rows respectively face that in the other row. Each of the signal terminals includes a signal fixing segment engaged with the insulating housing, a signal contacting segment, and a signal soldering segment. The signal contacting segment has a main transmission point and a secondary transmission point, which are spaced apart from each other along the insertion direction. The main transmission point is closer to the signal fixing segment than the secondary transmission point.

8 Claims, 12 Drawing Sheets

(56) References Cited

U.S. PATENT DOCUMENTS

| | | | | | |
|---|---|---|---|---|---|
| 6,015,299 | A * | 1/2000 | Walse | H01R 12/721 | 439/60 |
| 6,443,740 | B1 * | 9/2002 | Evans | H01R 13/6585 | 439/63 |
| 6,638,111 | B1 * | 10/2003 | McDaid | H01R 12/724 | 439/108 |
| 6,863,572 | B1 * | 3/2005 | Yi | H01R 12/721 | 439/59 |
| 6,988,913 | B2 * | 1/2006 | Zhang | H01R 13/245 | 439/637 |
| 7,229,321 | B2 * | 6/2007 | Hegel | H01R 13/112 | 439/637 |
| 7,604,510 | B2 * | 10/2009 | Akama | H01R 13/6585 | 439/637 |
| 7,892,037 | B2 * | 2/2011 | Kodera | H01R 13/6474 | 439/660 |
| 8,083,526 | B2 * | 12/2011 | Long | H01R 13/6585 | 439/60 |
| 8,535,069 | B2 * | 9/2013 | Zhang | H01R 13/6471 | 439/108 |
| 8,550,855 | B2 * | 10/2013 | Zhang | H01R 13/405 | 439/636 |
| 8,597,036 | B2 * | 12/2013 | Fogg | H01R 13/6585 | 439/101 |
| 8,747,164 | B2 * | 6/2014 | Westman | H01R 12/721 | 439/637 |
| 9,257,793 | B2 * | 2/2016 | Lo | H01R 13/6471 | |
| 10,811,794 | B2 * | 10/2020 | Annis | H01R 12/721 | |

* cited by examiner

HIGH SPEED CONNECTOR ASSEMBLY AND ELECTRICAL CONNECTOR THEREOF

FIELD OF THE DISCLOSURE

The present disclosure relates to a high speed connector, and more particularly to a high speed connector assembly and an electrical connector thereof.

BACKGROUND OF THE DISCLOSURE

A conventional high speed connector includes a plurality of signal terminals, and each of the signal terminals has a specific structure for transmitting high speed signal. However, when the conventional high speed connector is used to transmit high speed signals, the transmission performance of the conventional high speed connector is limited by the specific structure of each of the signal terminals, so that the transmission performance is difficult to be improved.

SUMMARY OF THE DISCLOSURE

In response to the above-referenced technical inadequacies, the present disclosure provides a high speed connector assembly and an electrical connector thereof to effectively improve the issues associated with conventional high speed connectors.

In one aspect, the present disclosure provides a high speed connector assembly, which includes an electrical connector and a mating connector that is detachably inserted into the electrical connector along the insertion direction. The electrical connector includes an insulating housing and a plurality of signal terminals. The insulating housing is in an elongated shape defining a longitudinal direction, and the insulating housing defines an insertion direction perpendicular to the longitudinal direction. The signal terminals are inserted into and fixed in the insulating housing. The signal terminals are arranged in two rows each parallel to the longitudinal direction, and the signal terminals in one of the two rows respectively face the signal terminals in the other one of the two rows. Each of the signal terminals includes a signal fixing segment, a signal contacting segment, and a signal soldering segment. The signal fixing segment is engaged with an inner wall of the insulating housing. The signal contacting segment and the signal soldering segment respectively extend from two opposite ends of the signal fixing segment. The signal contacting segment has a main transmission point and a secondary transmission point, the main transmission point and the secondary transmission point are arranged along the insertion direction and are spaced apart from each other by a first distance, and the main transmission point is closer to the signal fixing segment than the secondary transmission point. The mating connector includes a mating housing and a plurality of mating signal terminals fixed in the mating housing. When the electrical connector is inserted into the mating connector, the signal contacting segments of the signal terminals are respectively abutted against the mating signal terminals, the main transmission point and the secondary transmission point of each of the signal contacting segments simultaneously contact the corresponding mating signal terminal, and a second distance between each of the main transmission point and a free end of the corresponding mating signal terminal is less than the first distance and is less than 10% of a total length of the corresponding mating signal terminal.

In one aspect, the present disclosure provides an electrical connector including an insulating housing and a plurality of signal terminals. The insulating housing is in an elongated shape defining a longitudinal direction, and the insulating housing defines an insertion direction perpendicular to the longitudinal direction. The signal terminals are inserted into and fixed in the insulating housing. The signal terminals are arranged in two rows each parallel to the longitudinal direction, and the signal terminals in one of the two rows respectively face the signal terminals in the other one of the two rows. Each of the signal terminals includes a signal fixing segment, a signal contacting segment, and a signal soldering segment. The signal fixing segment is engaged with an inner wall of the insulating housing. The signal contacting segment and the signal soldering segment respectively extend from two opposite ends of the signal fixing segment. The signal contacting segment has a main transmission point and a secondary transmission point, the main transmission point and the secondary transmission point are arranged along the insertion direction and are spaced apart from each other by a first distance, and the main transmission point is closer to the signal fixing segment than the secondary transmission point.

Therefore, in the high speed connector assembly of the present disclosure, the main transmission point and the secondary transmission point of each of the signal contacting segments can simultaneously contact the corresponding mating signal terminal, which is different from conventional signal transmission structures, so that the transmission performance of the high speed connector assembly for high frequency signals can be increased. Moreover, the high speed connector assembly of the present disclosure can be formed with the main transmission point and the secondary transmission point on each of the signal contacting segments, so that the second distance between the free end of each of the mating signal terminals and the corresponding main transmission point can be reduced, preventing a stub effect from affecting the signal transmission of the high speed connector assembly.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
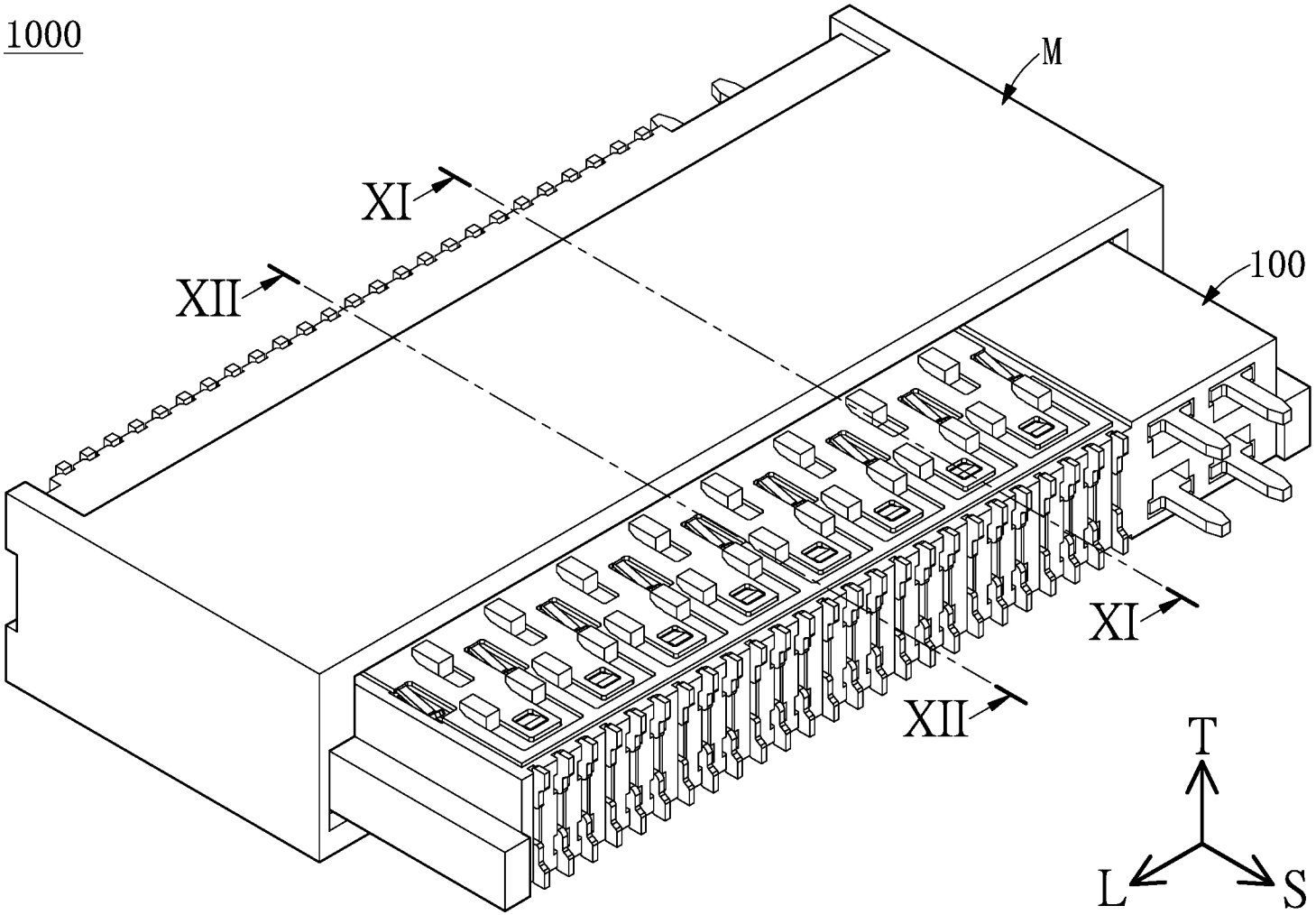
FIG. 1 is a perspective view of a high speed connector assembly according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
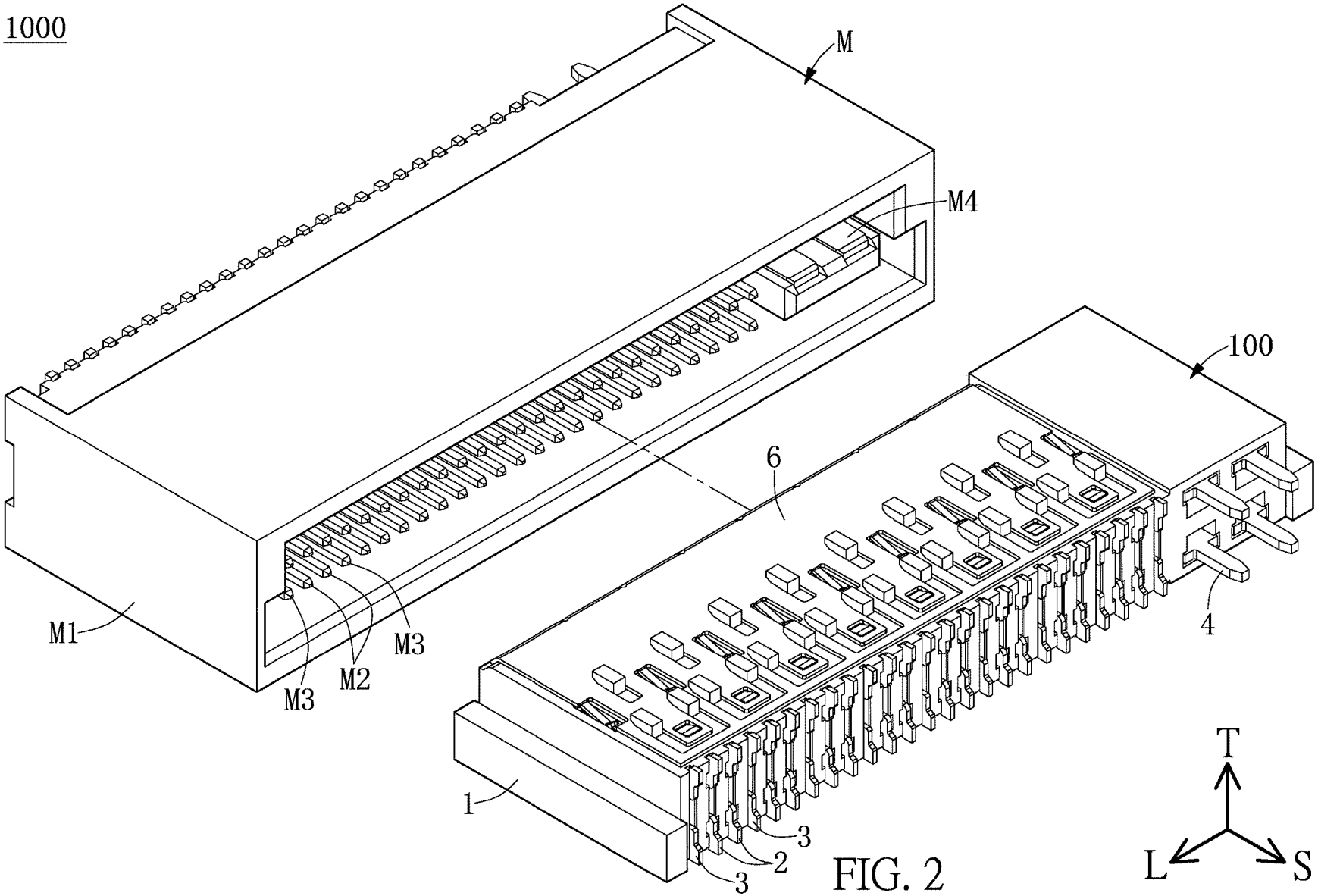
FIG. 2 is an exploded view of FIG. 1.

Referring to FIG. 1 to FIG. 12, an embodiment of the present disclosure provides a high speed connector assembly 1000. As shown in FIG. 1 and FIG. 2, the high speed connector assembly 1000 includes an electrical connector 100 and a mating connector M that is detachably inserted into the electrical connector 100 along an insertion direction S. The high speed connector assembly 1000 in the present embodiment is used to transmit a signal having a frequency less than 12 GHz under a transmission rate of 25 GBps, and the high speed connector assembly 1000 in the signal transmission has an insertion loss that can be controlled to be less than −0.5 dB and a near-end crosstalk that can be controlled to be less than −25 dB, but the present disclosure is not limited thereto.

It should be noted that the electrical connector 100 in the present embodiment is a vertical connector and is in cooperation with the mating connector M, but the present disclosure is not limited thereto. For example, in other embodiments of the present disclosure, the electrical connector 100 can be independently applied or in cooperation with other components.

Figure 3:
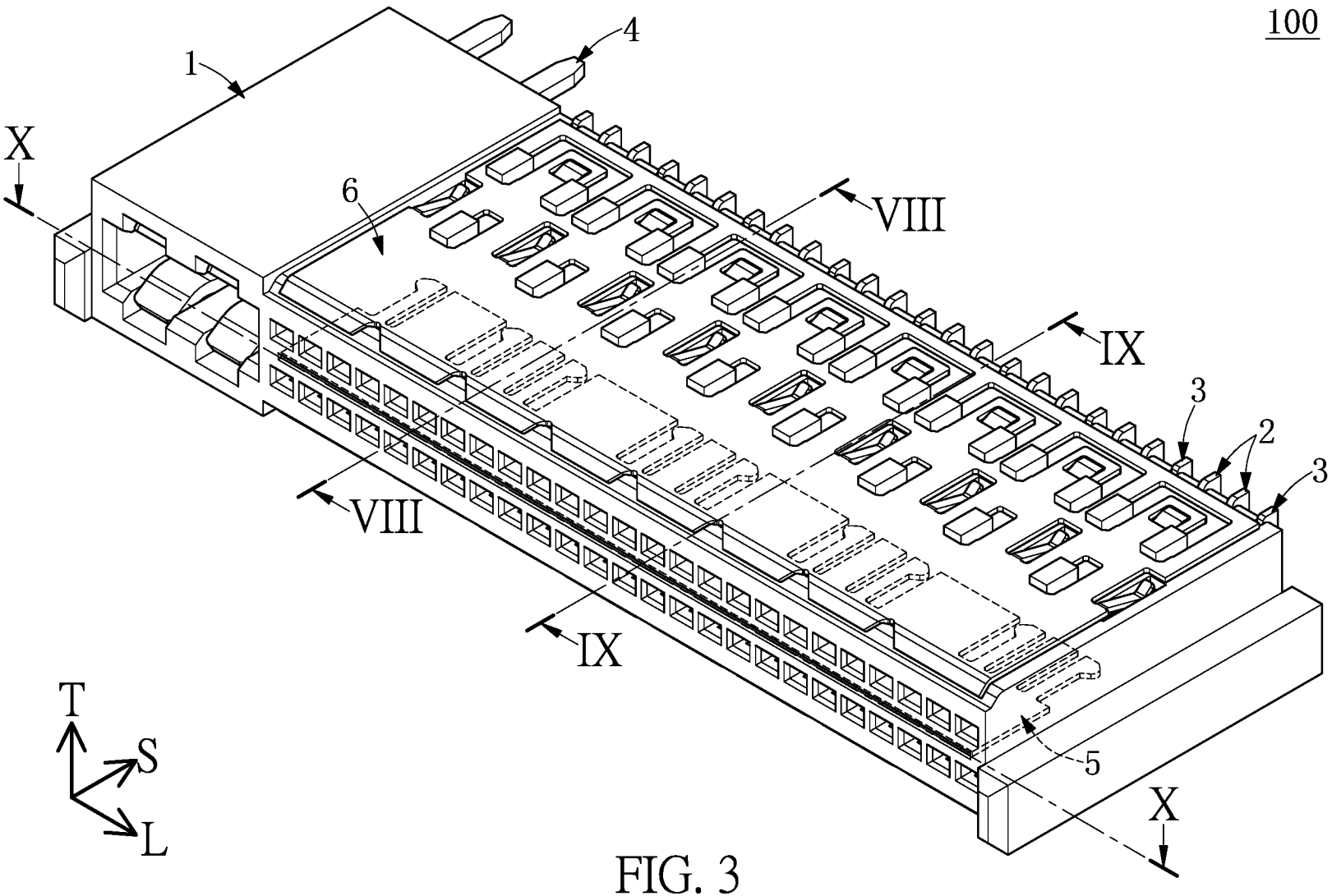
FIG. 3 is a perspective view of an electrical connector according to the embodiment of the present disclosure.
Figure 4:
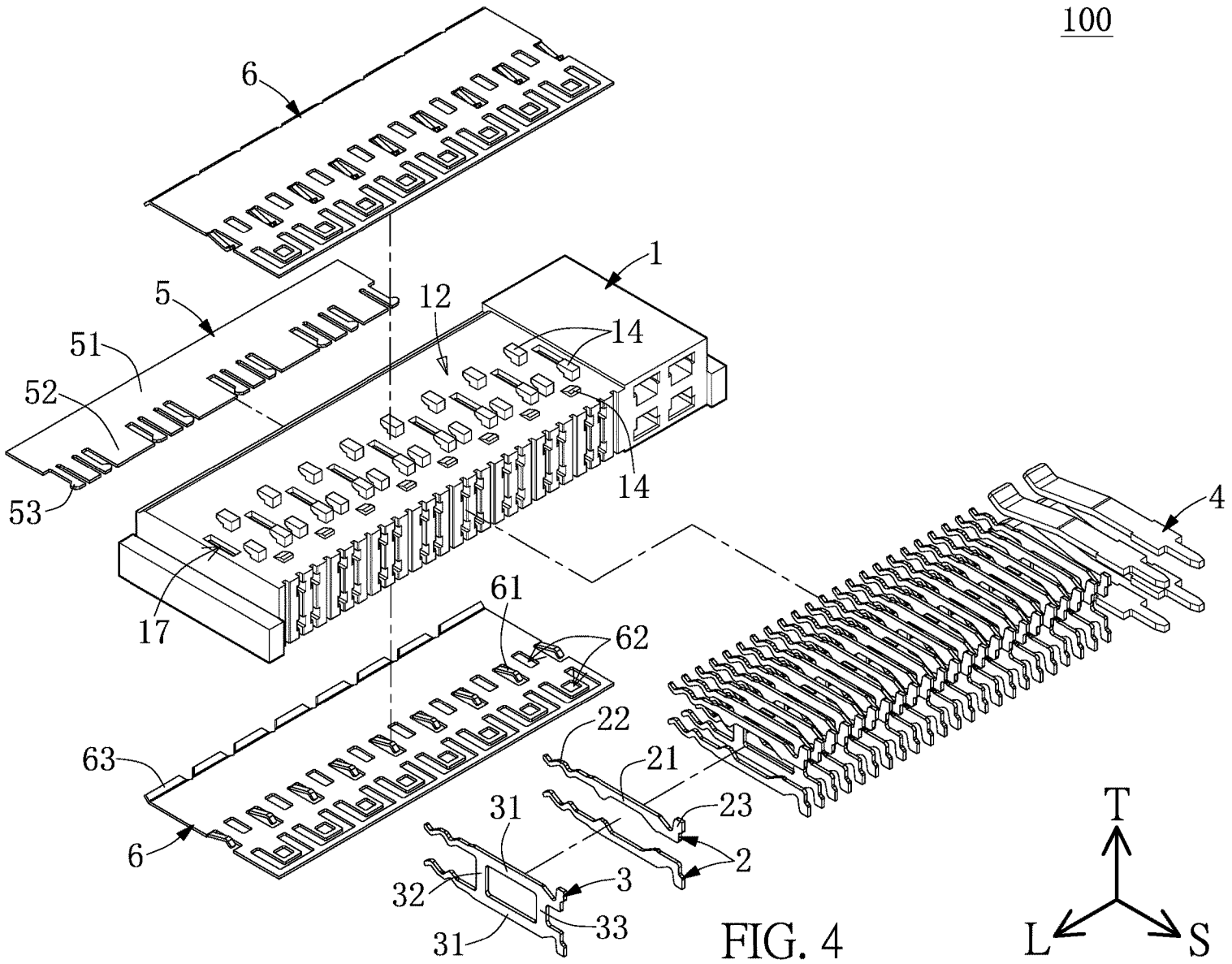
FIG. 4 is an exploded view showing the electrical connector of FIG. 1.
Figure 5:
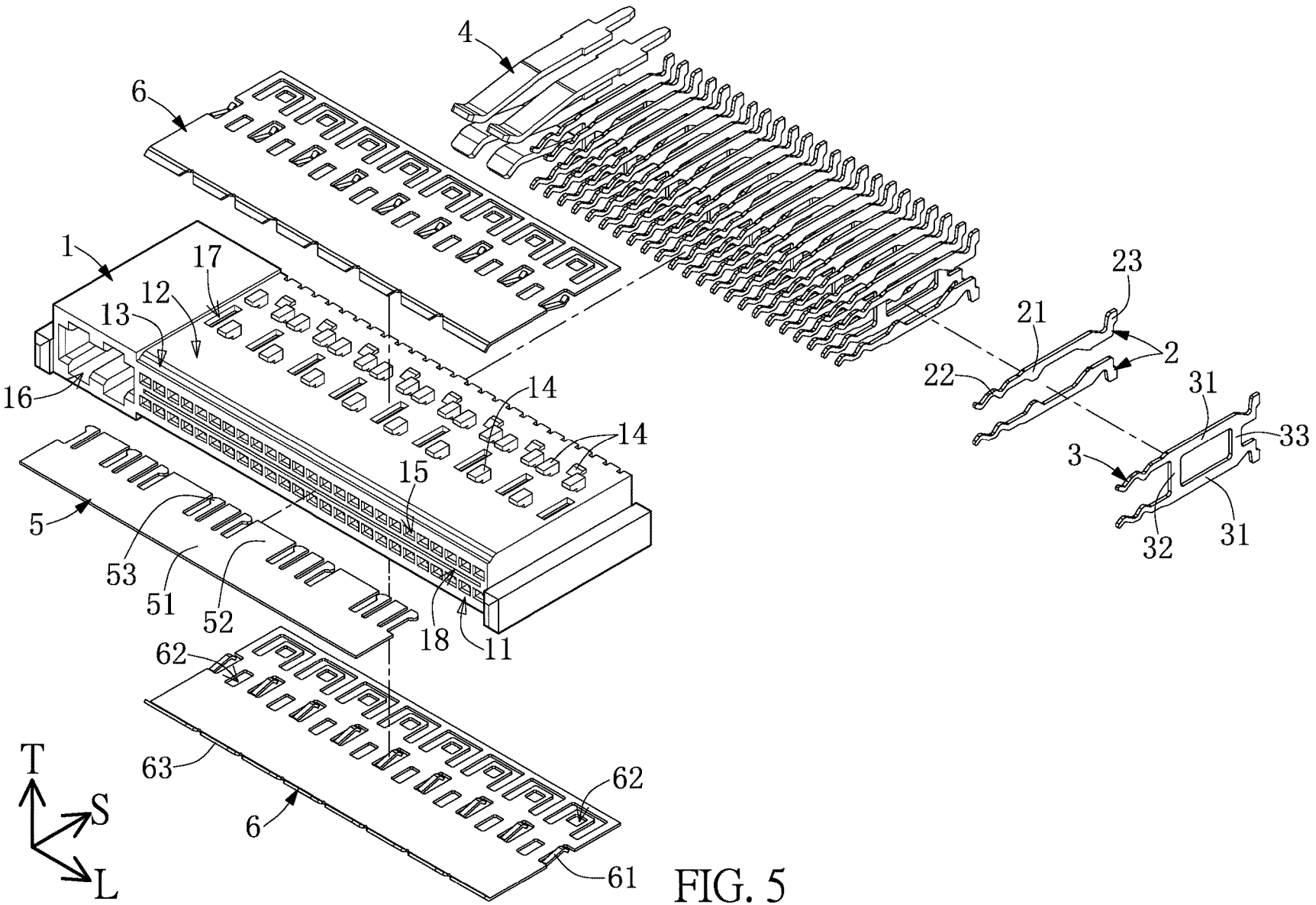
FIG. 5 is an exploded view of FIG. 3.

As shown in FIG. 3 to FIG. 5, the electrical connector 100 in the present embodiment includes an insulating housing 1, a plurality of signal terminals 2, a plurality of ground members 3 staggeredly arranged with the signal terminals, a plurality of power terminals 4 arranged at one side of the signal terminals 2 and ground members 3, an inner shielding member 5 abutted against the ground members 3, and two outer shielding members 6 abutted against the ground members 3. The signal terminals 2, the ground members 3, the power terminals 4, and the inner shielding member 5 are inserted into and fixed in the insulating housing 1, and the two outer shielding members 6 are detachably engaged with an outer surface of the insulating housing 1.

In addition, the electrical connector 100 in the present embodiment includes the above components, but the components of the electrical connector 100 can be changed according to design requirements. For example, in other embodiments of the present disclosure, at least one of the power terminals 4, the inner shielding member 5, and the two outer shielding members 6 can be omitted or replaced by other components. The following description describes the structure and connection relationship of each component of the electrical connector 100 of the present embodiment.

The insulating housing 1 is in an elongated shape defining a longitudinal direction L that is perpendicular to the insertion direction S, and the insulating housing 1 defines a thickness direction T perpendicular to the longitudinal direction L and the insertion direction S.

The insulating housing 1 includes an insertion surface 11 substantially perpendicular to the insertion direction S, two outer side surfaces 12 arranged on two opposite sides thereof and substantially perpendicular to the thickness direction T, two guiding surfaces 13 respectively extending from two edges of the insertion surface 11 to the two outer side surfaces 12, and a plurality of engaging protrusions 14 formed on the two outer side surfaces 12.

The insulating housing 1 has a plurality of terminal slots 15 and a power slot 16 which are recessed from the insertion surface 11 to penetrate through insulating housing 1 along the insertion direction S. The terminal slots 15 are arranged in two rows each parallel to the longitudinal direction L, and the power slot 16 is arranged at one side of the two rows of the terminal slots 15. Moreover, the insulating housing 1 has a plurality of thru-holes 17 recessed from the two outer side surfaces 12 along the thickness direction T, and the thru-holes 17 are respectively in spatial communication with a portion of the terminal slots 15. The insulating housing 1 has a shielding slot 18 recessed from the insertion surface 11 along the insertion direction S, and the shielding slot 18 is arranged between the two rows of the terminal slots 15.

The signal terminals 2 and the ground members 3 are respectively inserted into the terminal slots 15 of the insulating housing 1, and the power terminals 4 are inserted into the power slot 16 and are arranged at one side of the signal terminals 2 and the ground members 3. The signal terminals 2 are arranged in two rows each parallel to the longitudinal direction L, and the signal terminals 2 in one of the two rows respectively face the signal terminals 2 in the other one of the two rows. In the present embodiment, two of the signal terminals 2 arranged in the same row and adjacent to each other are defined as a differential signal pair for jointly transmitting a differential signal.

As the signal terminals 2 are of the same structure, the following description discloses the structure of just one of the signal terminals 2 for the sake of brevity, but the present disclosure is not limited thereto. For example, in other embodiments of the present disclosure, the signal terminals 2 of the electrical connector 100 can be formed in different structures.

Figure 6:
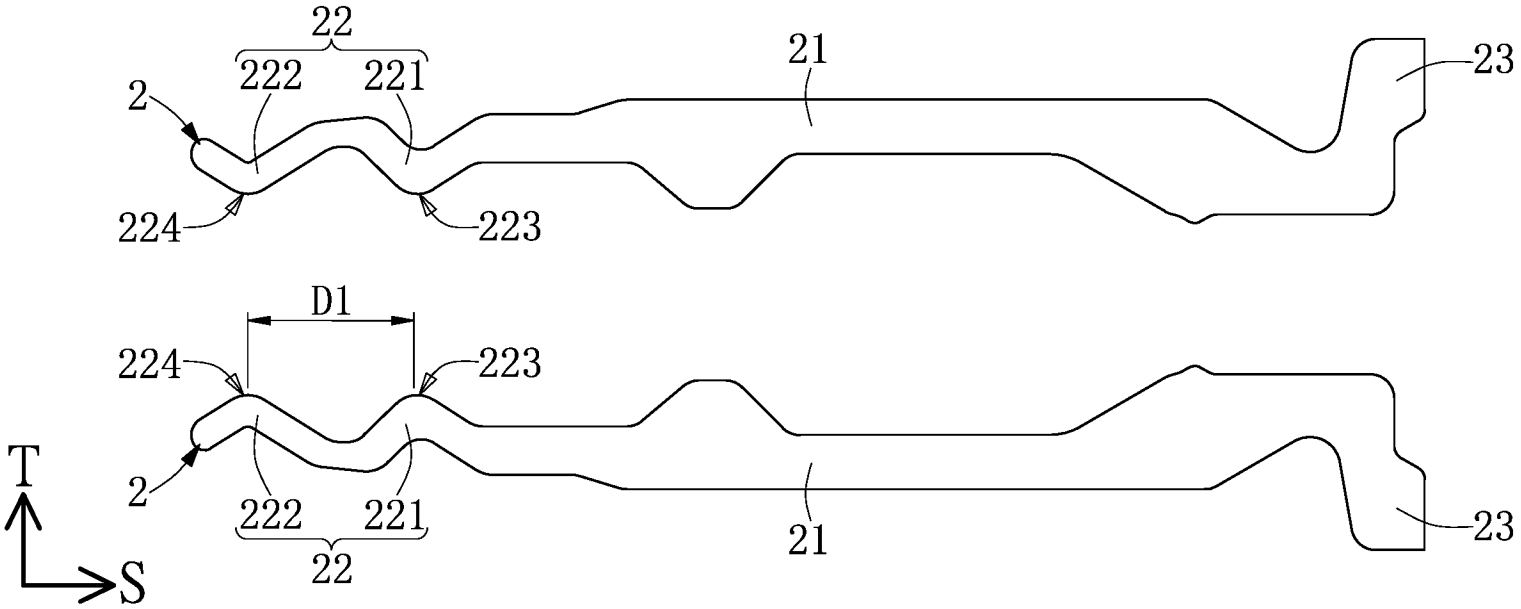
FIG. 6 is a planar view of two signal terminals according to the embodiment of the present disclosure.
Figure 8:
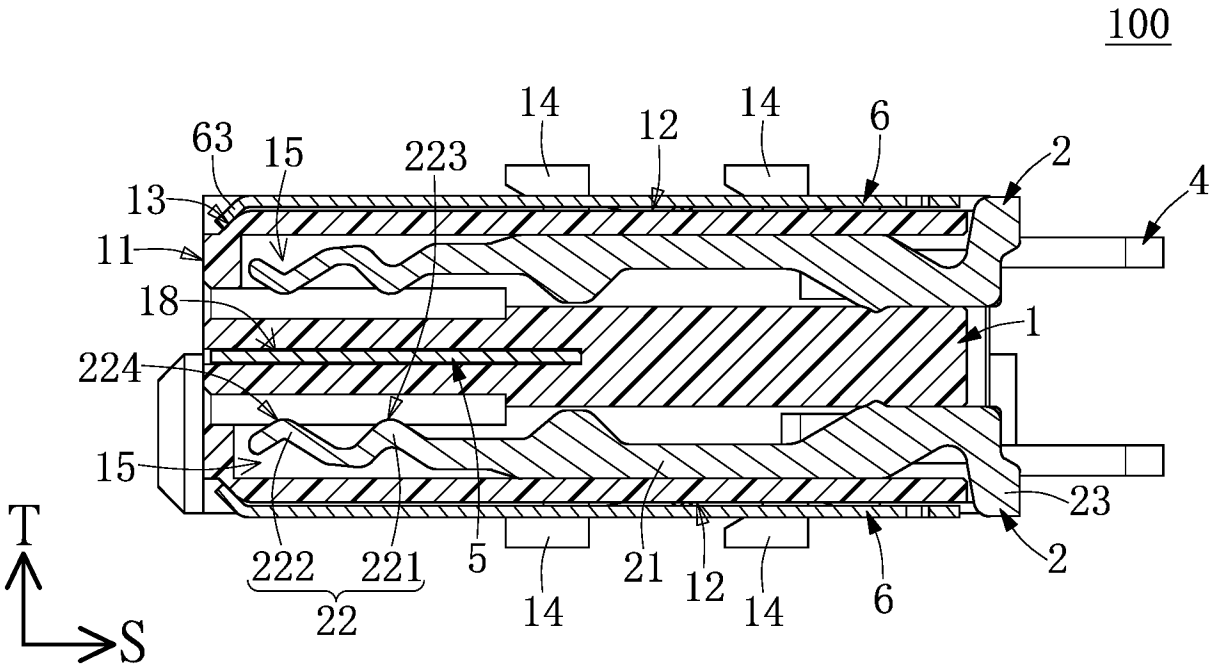
FIG. 8 is a cross-sectional view taken along line VIII-VIII of FIG. 3.

As shown in FIG. 5, FIG. 6, and FIG. 8, the signal terminal 2 in the present embodiment is integrally formed as a single one-piece structure, and includes a signal fixing segment 21, a signal contacting segment 22, and a signal soldering segment 23, the latter two of which respectively extend from two opposite ends of the signal fixing segment 21. The signal fixing segment 21 is engaged with an inner wall of (the corresponding terminal slot 15 of) the insulating housing 1. In the present embodiment, one lateral edge of the signal fixing segment 21 is abutted against the inner wall of the insulating housing 1, and the other lateral edge of the signal fixing segment 21 is piercingly fixed to the inner wall of the insulating housing 1 by thorns thereof, but the present disclosure is not limited thereto.

The signal contacting segment 22 in the present embodiment does not contact the insulating housing 1, so that the signal contacting segment 22 can be elastically deformed. The signal contacting segment 22 includes a V-shaped first signal contacting portion 221 and an L-shaped second signal contacting portion 222 that is connected to the first signal contacting portion 221. Moreover, a peak of the first signal contacting portion 221 is defined as a main transmission point 223, and a peak of the second signal contacting portion 222 is defined as a secondary transmission point 224. The main transmission point 223 is closer to the signal fixing segment 21 than the secondary transmission point 224, and the main transmission point 223 and the secondary transmission point 224 are arranged along the insertion direction S and are spaced apart from each other by a first distance D1.

However, in other embodiments of the present disclosure, the signal contacting segment 22 can include the main transmission point 223 and the secondary transmission point 224, which are spaced apart from each other by the first distance D1 in the insertion direction S, through other structures different from the V-shaped first signal contacting portion 221 and the L-shaped second signal contacting portion 222.

In addition, the signal soldering segment 23 in the present embodiment is a pin tail that is used for the surface mounting technology (SMT) soldering process, but the present disclosure is not limited thereto. For example, in other embodiments of the present disclosure, the signal soldering segment 23 can be a fish-eye shaped pin tail that is used for inserting into a hole.

The ground members 3 are arranged along the longitudinal direction L, and two of the ground members 3 adjacent to each other are provided with four of the signal terminals 2 in the two rows (i.e., two differential signal pairs) therebetween. In other words, one side of the any one of the ground members 3 is provided with two of the signal terminals 2 facing each other and respectively arranged in the two rows. Any one of the ground members 3 in the present embodiment preferably covers at least 95% of the adjacent two signal terminals 2 along the longitudinal direction L, but the present disclosure is not limited thereto.

As the ground members 3 are of the same structure, the following description discloses the structure of just one of the ground members 3 for the sake of brevity, but the present disclosure is not limited thereto. For example, in other embodiments of the present disclosure, the ground members 3 of the electrical connector 100 can be formed in different structures.

Figure 7:
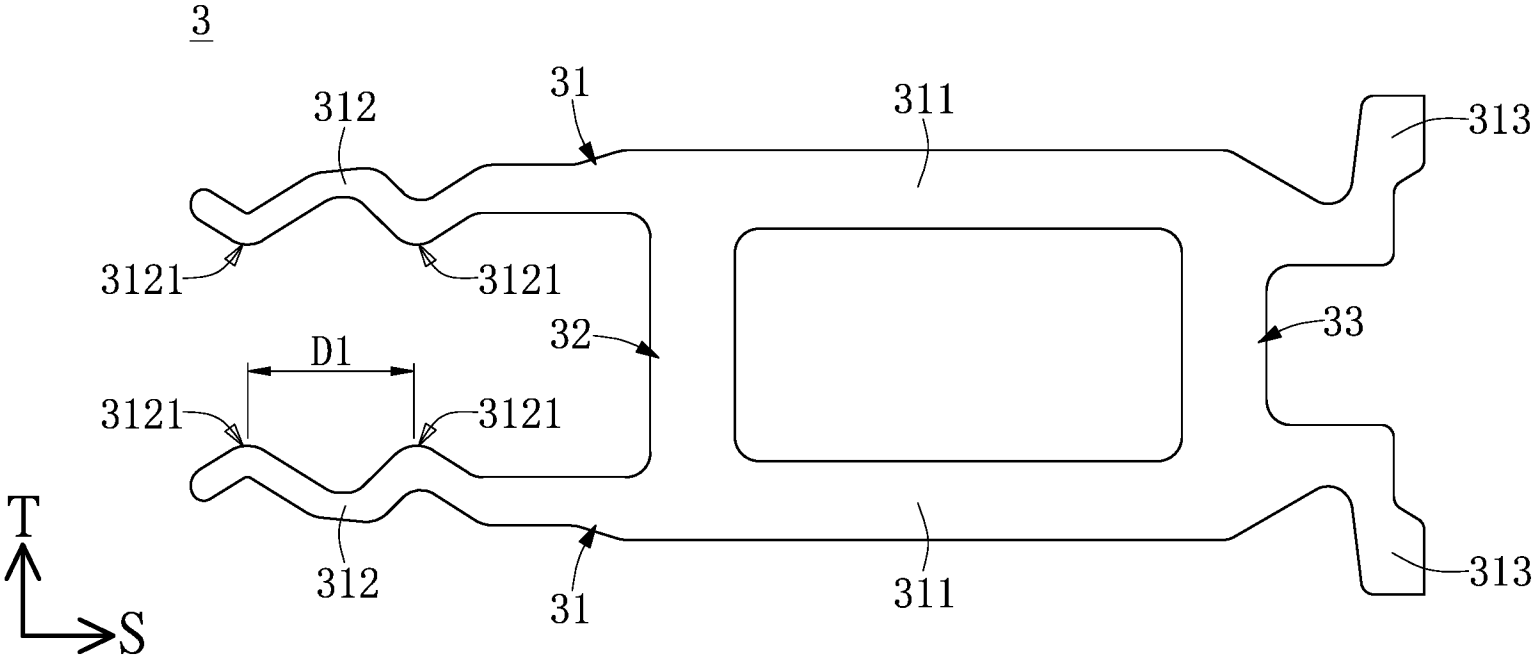
FIG. 7 is a planar view of a ground member according to the embodiment of the present disclosure.
Figure 9:
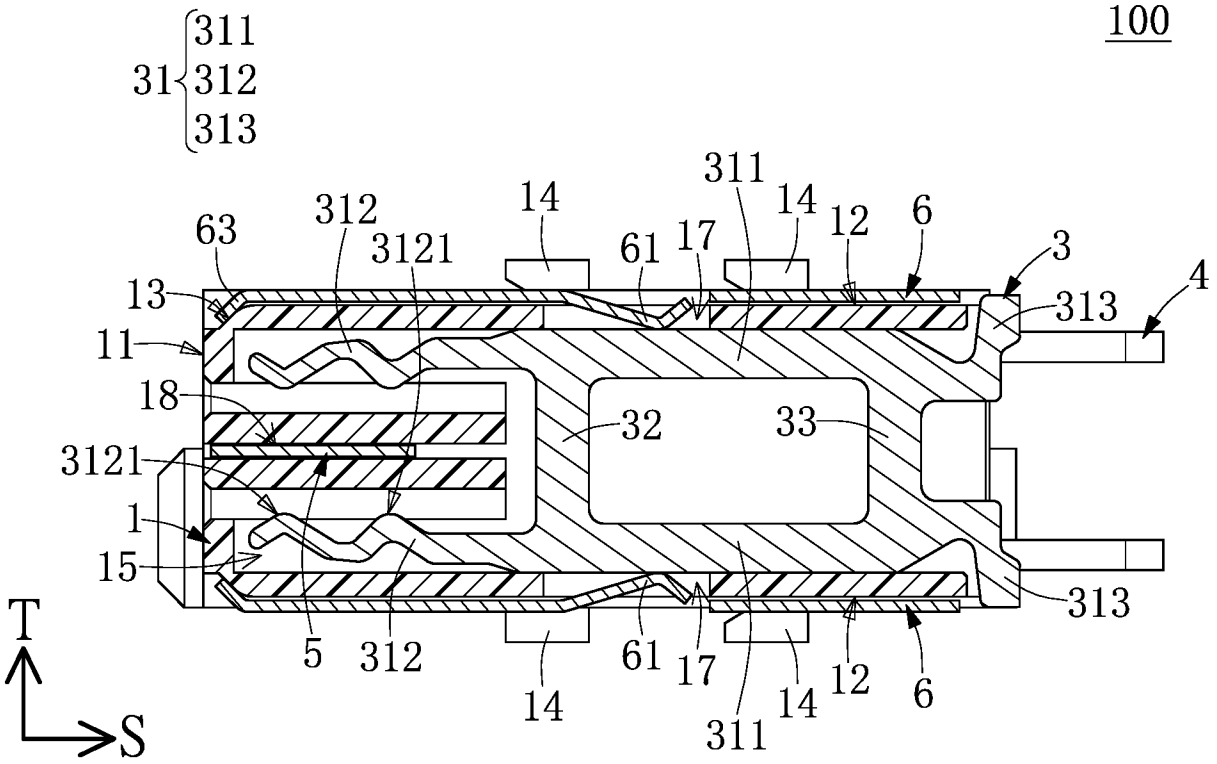
FIG. 9 is a cross-sectional view taken along line IX-IX of FIG. 3.
Figure 10:
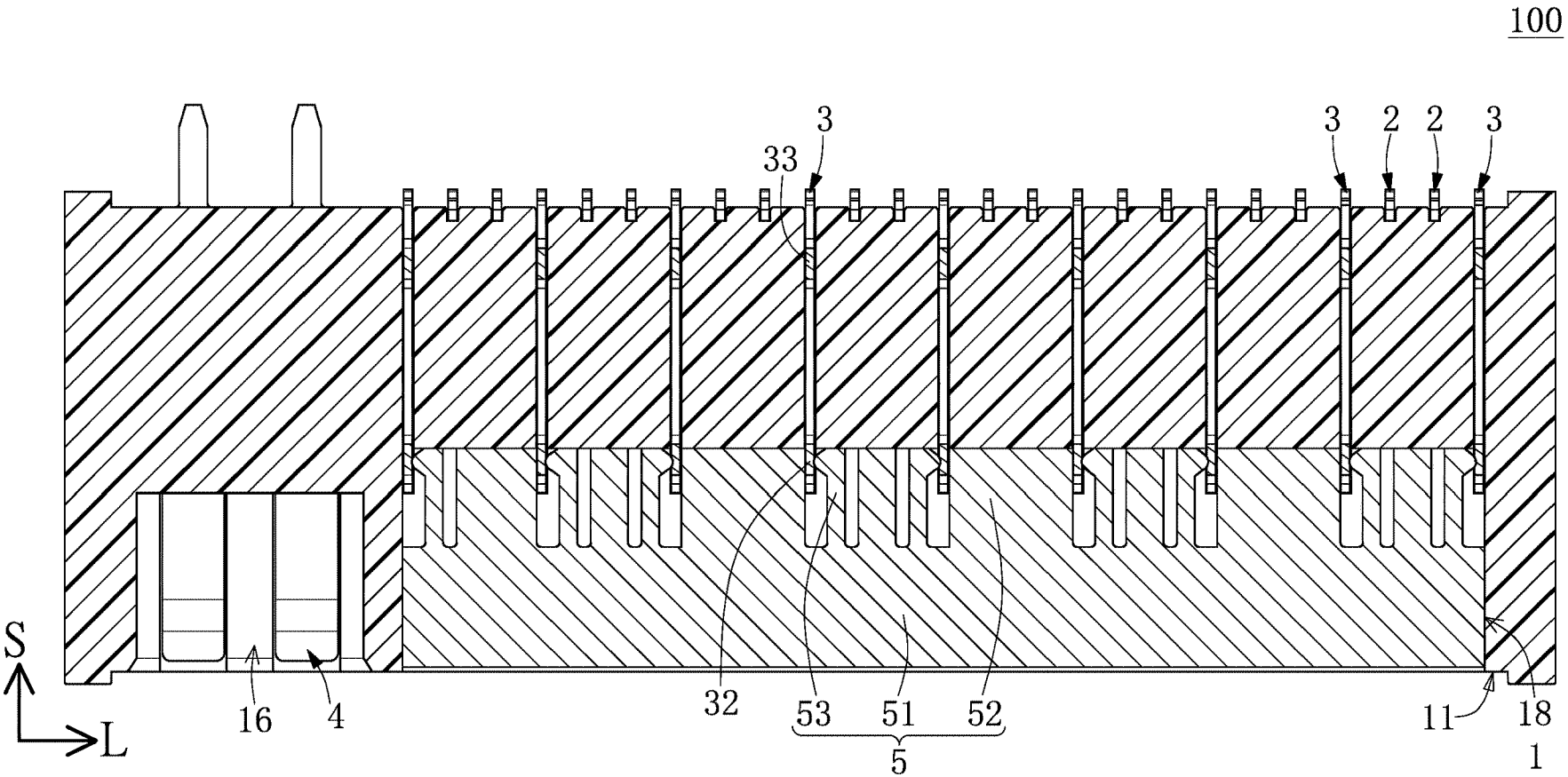
FIG. 10 is a cross-sectional view taken along line X-X of FIG. 3.

As shown in FIG. 5, FIG. 7, and FIG. 9, the ground member 3 in the present embodiment is integrally formed as a one-piece structure. The ground member 3 includes two ground terminals 31 facing each other along the thickness direction T, a front bridge 32 connected to the two ground terminals 31, and a rear bridge 33 connected to the two ground terminals 31. The rear bridge 33 is preferably spaced apart from the front bridge 32 in the insertion direction S.

The two ground terminals 31 are respectively arranged in the two rows of the signal terminals 2, and the structure of each of the ground terminals 31 is similar to that of any one of the signal terminals 2. Specifically, each of the ground terminals 31 includes a ground fixing segment 311 engaged with the inner wall of (the corresponding terminal slot 15 of) the insulating housing 1, a ground contacting segment 312, and a ground soldering segment 313, the latter two of which respectively extend from two opposite ends of the ground fixing segment 311.

The ground fixing segments 311 of the two ground terminals 31 respectively correspond in position to two of the thru-holes 17 that are respectively arranged on the two outer side surfaces 12 of the insulating housing 1. In other words, the ground terminals 31 of electrical connector 100 respectively correspond in position to the thru-holes 17 of the insulating housing 1. In addition, the ground fixing segments 311 of the two ground terminals 31 are connected to the front bridge 32 and the rear bridge 33, and each of front bridge 32 and the rear bridge 33 is in an elongated shape perpendicular to the insertion direction S. Accordingly, the front bridge 32, the rear bridge 33, and the ground fixing segments 311 jointly and surroundingly form a rectangular space, so that the ground member 3 can have enough structural strength and can be elastically deformed in a specific range.

Moreover, the shapes of the ground contacting segment 312 and the ground soldering segment 313 of each of the two ground terminals 31 in the present embodiment are substantially identical to that of the signal contacting segment 22 and the signal soldering segment 23, but the present disclosure is not limited thereto. Specifically, the ground contacting segment 312 has two contacting points 3121 that are arranged along the insertion direction S and are spaced apart from each other by the first distance D1, and the ground soldering segment 313 is a pin tail that is used for the SMT soldering process.

As shown in FIG. 5 and FIG. 8 to FIG. 10, the inner shielding member 5 is inserted into and fixed in the shielding slot 18 of the insulating housing 1, the inner shielding member 5 does not protrude from the insertion surface 11 of the insulating housing 1, and the signal contacting segments 22 of two of the signal terminals 2 facing each other are separated from each other by the inner shielding member 5. The inner shielding member 5 is abutted against the front bridge 32 of each of the ground members 3, so that the ground members 3 can be electrically coupled to each other through the inner shielding member 5. The specific structure of the inner shielding member 5 can be changed according to design requirements, and the present disclosure is not limited thereto.

In the present embodiment, the inner shielding member 5 includes a base portion 51 parallel to the longitudinal direction L, a plurality of sheets 52, and a plurality of engaging arms 53, the latter two of which extend from the base portion 51 along the insertion direction S. The sheet 52 and the engaging arms 53 are staggeredly arranged with each other. The sheet 52 is abutted against the insulating housing 1 along the insertion direction S, and the engaging arms 53 are respectively abutted against the front bridges 32 of the ground members 3 along the longitudinal direction L. It should be noted that at least one of the engaging arms 53 and the adjacent sheet 52 can jointly clamp the corresponding front bridge 32 along the longitudinal direction L, thereby increasing the stability of the connection.

The two outer shielding members 6 are detachably engaged with the two outer side surfaces 12 of the insulating housing 1. Each of the two outer shielding members 6 includes a plurality of elastic aims 61 respectively corresponding in position to the thru-holes 17, and the elastic arms 61 of the two outer shielding members 6 are detachably and respectively abutted against the ground terminals 31 by passing through the thru-holes 17, so that the ground member 3 can be electrically coupled to each other through any one of the two outer shielding members 6.

Moreover, the ground members 3, the inner shielding member 5, and the two outer shielding members 6 of the electrical connector 100 can be electrically coupled to each other so as to be commonly grounded. An interior space of the electrical connector 100 can be divided into a plurality of shielding chambers (not labeled) through the ground members 3, the inner shielding member 5, and the two outer shielding members 6, and each of the shielding chambers can be used to receive one of the differential signal pair. Accordingly, the differential signal pairs of the electrical connector 100 can be effectively separated from each other for providing a better signal transmission effect.

Specifically, each of the two outer shielding members 6 in the present embodiment includes a plurality of engaging holes 62, and the engaging holes 62 of each of the two outer shielding members 6 are respectively engaged with the engaging protrusions 41 on the corresponding outer side surface 12 of the insulating housing 1. Moreover, each of the two outer shielding members 6 includes a plurality of positioning claws 63, and the positioning claws 63 of the two outer shielding members 6 are respectively abutted against the two guiding surfaces 13 of the insulating housing 1. Accordingly, the two outer shielding members 6 can be firmly engaged with the two outer side surfaces 12 of the insulating housing 1.

Figure 11:
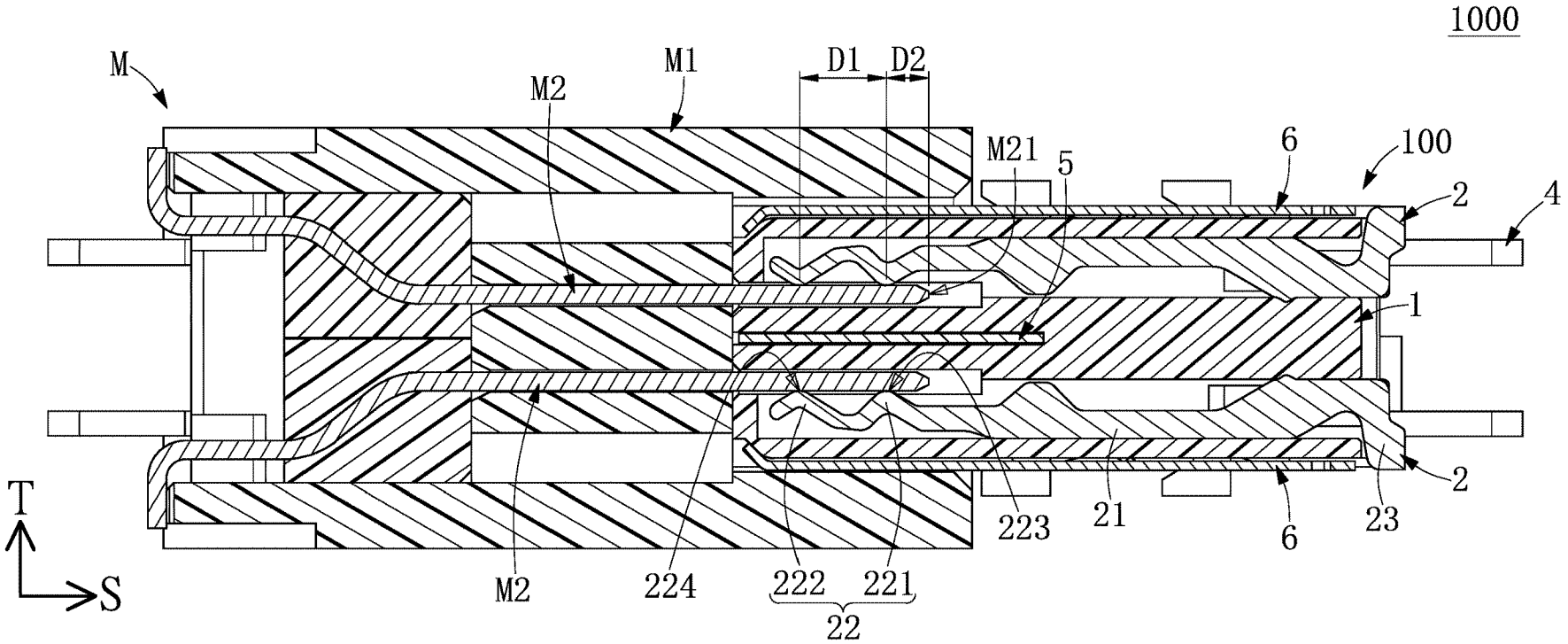
FIG. 11 is a cross-sectional view taken along line XI-XI of FIG. 1.
Figure 12:
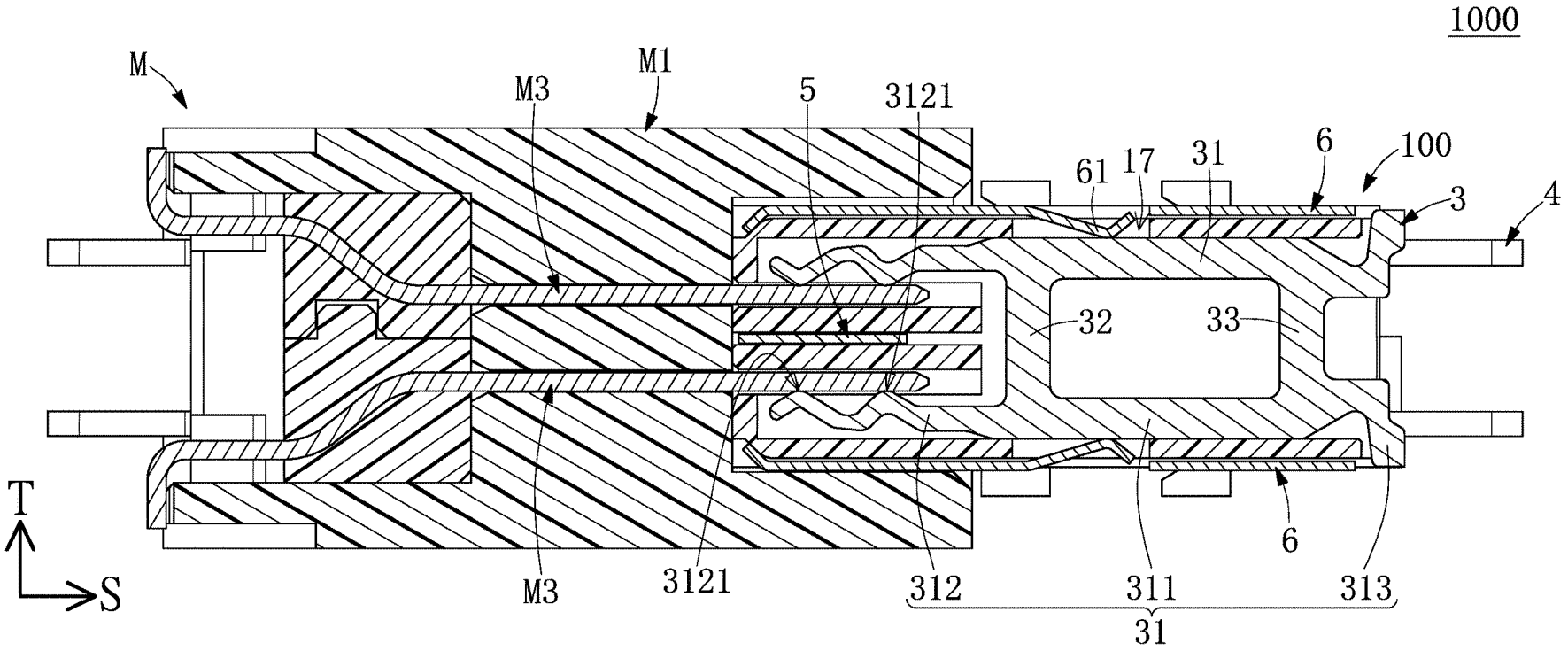
FIG. 12 is a cross-sectional view taken along line XII-XII of FIG. 1.

As shown in FIG. 2, FIG. 11, and FIG. 12, the mating connector M in the present embodiment includes a mating housing M1, a plurality of mating signal terminals M2, a plurality of mating ground terminals M3, and a plurality of power terminals M4. The mating signal terminals M2, the mating ground terminals M3, and the power terminals M4 are fixed in the mating housing M1.

When the electrical connector 100 is inserted into the mating connector M along the insertion direction S, the signal contacting segments 22 of the signal terminals 2 are respectively abutted against the mating signal terminals M2, the ground contacting segments 312 of the ground terminals 31 are respectively abutted against the mating ground terminals M3, and the power terminals 4 are respectively abutted against the mating power terminals M4.

Specifically, when the electrical connector 100 is inserted into the mating connector M along the insertion direction S, the two contacting points 3121 of each of the ground contacting segments 312 simultaneously contact the corresponding mating ground terminal M3, and the main transmission point 223 and the secondary transmission point 224 of each of the signal contacting segments 22 simultaneously contact the corresponding mating signal terminal M2. Moreover, a second distance D2 between each of the main transmission point 223 and a free end M21 of the corresponding mating signal terminal M2 is less than the first distance D1, and is less than 10% of a total length of the corresponding mating signal terminal M2.

Accordingly, in the high speed connector assembly 1000 of the present embodiment, the main transmission point 223 and the secondary transmission point 224 of each of the signal contacting segments 22 can simultaneously contact the corresponding mating signal terminal M2, which is different from conventional signal transmission structures, so that the transmission performance of the high speed connector assembly 1000 for high frequency signal can be increased. Specifically, the secondary transmission point 224 of each of the signal terminals 2 in the present embodiment is configured to transmit signal only when the high speed connector assembly 1000 is shaken by an external force so that the main transmission point 223 is separated from the corresponding mating signal terminal M2.

Moreover, the high speed connector assembly 1000 of the present embodiment can be formed with the main transmission point 223 and the secondary transmission point 224 on each of the signal contacting segments 22, so that the second distance D2 between the free end M21 of each of the mating signal terminals M2 and the corresponding main transmission point 223 can be reduced, preventing a stub effect from affecting the signal transmission of the high speed connector assembly 1000.

In conclusion, in the high speed connector assembly of the present disclosure, the main transmission point and the secondary transmission point of each of the signal contacting segments can simultaneously contact the corresponding mating signal terminal, which is different from conventional signal transmission structures, so that the transmission performance of the high speed connector assembly for high frequency signal can be increased. Moreover, the high speed connector assembly of the present disclosure can be formed with the main transmission point and the secondary transmission point on each of the signal contacting segments, so that the second distance between the free end of each of the mating signal terminals and the corresponding main transmission point can be reduced, preventing a stub effect from affecting the signal transmission of the high speed connector assembly.

In addition, the ground members, the inner shielding member, and the two outer shielding members of the electrical connector in the present disclosure can be electrically coupled to each other so as to be commonly grounded. An interior space of the electrical connector can be divided into a plurality of shielding chambers through the ground members, the inner shielding member, and the two outer shielding members, and each of the shielding chambers can be used to receive one of the differential signal pair. Accordingly, the differential signal pairs of the electrical connector can be effectively separated from each other for providing a better signal transmission effect.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated.

Alternative embodiments will become apparent to those skilled in the art to which the present disclosure pertains without departing from its spirit and scope.

What is claimed is:

1. A high speed connector assembly, comprising:

an electrical connector including:

an insulating housing being in an elongated shape defining a longitudinal direction, wherein the insulating housing defines an insertion direction perpendicular to the longitudinal direction; and a plurality of signal terminals inserted into and fixed in the insulating housing, wherein the signal terminals are arranged in two rows each parallel to the longitudinal direction, the signal terminals in one of the two rows respectively face the signal terminals in another one of the two rows, and each of the signal terminals includes:

a signal fixing segment engaged with an inner wall of the insulating housing; and a signal contacting segment and a signal soldering segment respectively extending from two opposite ends of the signal fixing segment, wherein the signal contacting segment has a main transmission point and a secondary transmission point, the main transmission point and the secondary transmission point are arranged along the insertion direction and are spaced apart from each other by a first distance, and the main transmission point is closer to the signal fixing segment than the secondary transmission point; and a mating connector, wherein the electrical connector is detachably inserted into the mating connector along the insertion direction, and wherein the mating connector includes a mating housing and a plurality of mating signal terminals fixed in the mating housing, wherein, when the mating connector is inserted into the electrical connector, the signal contacting segments of the signal terminals are respectively abutted against the mating signal terminals, the main transmission point and the secondary transmission point of each of the signal contacting segments simultaneously contact the corresponding mating signal terminal, and a second distance between each of the main transmission point and a free end of the corresponding mating signal terminal is less than the first distance and is less than 10% of a total length of the corresponding mating signal terminal, wherein the mating connector includes a plurality of mating ground terminals fixed in the mating housing, the electrical connector includes a plurality of ground members inserted into and fixed in the insulating housing, the ground members are arranged along the longitudinal direction, and two of the ground members adjacent to each other are provided with four of the signal terminals in the two rows there-between, and wherein each of the ground members is integrally formed as a single one-piece structure and includes:

two ground terminals facing each other;

a front bridge connected to the two ground terminals; and a rear bridge connected to the two ground terminals and spaced apart from the front bridge in the insertion direction, wherein, when the electrical connector is inserted into the mating connector, the ground terminals are respectively abutted against the mating ground terminals, wherein the electrical connector further includes an inner shielding member inserted into and fixed in the insulating housing, the inner shielding member is abutted against the front bridge of each of the ground members, and the signal contacting segments of two of the signal terminals facing each other are separated from each other by the inner shielding member.

2. The high speed connector assembly according to claim 1, wherein in each of the signal terminals, the signal contacting segment does not contact the insulating housing, the signal contacting segment includes a V-shaped first signal contacting portion and an L-shaped second signal contacting portion that is connected to the first signal contacting portion, the main transmission point is arranged on a peak of the first signal contacting portion, and the secondary transmission point is arranged on a peak of the second signal contacting portion.

3. The high speed connector assembly according to claim 1, wherein the secondary transmission point of each of the signal terminals is configured to transmit signal only when the high speed connector assembly is shaken by an external force so that the main transmission point is separated from the corresponding mating signal terminal.

4. The high speed connector assembly according to claim 1, wherein each of the ground terminals includes:

a ground fixing segment engaged with the inner wall of the insulating housing and connected to the front bridge and the rear bridge; and a ground contacting segment and a ground soldering segment respectively extending from two opposite ends of the ground fixing segment, wherein the ground contacting segment has two contacting points that are arranged along the insertion direction and are spaced apart from each other, wherein, when the electrical connector is inserted into the mating connector, the ground contacting segments of the ground terminals are respectively abutted against the mating ground terminals, and the two contacting points of each of the ground contacting segments simultaneously contact the corresponding mating ground terminal.

5. The high speed connector assembly according to claim 1, wherein the insulating housing includes two outer side surfaces arranged on two opposite sides thereof, and the insulating housing has a plurality of thru-holes recessed from the two outer side surfaces and respectively corresponding in position to the ground terminals, and wherein the electrical connector includes two outer shielding members detachably engaged with the two outer side surfaces, each of the two outer shielding members includes a plurality of elastic arms, and the elastic arms of the two outer shielding members are detachably and respectively abutted against the ground terminals by passing through the thru-holes.

6. The high speed connector assembly according to claim 5, wherein the insulating housing includes an insertion surface, two guiding surfaces respectively extending from two edges of the insertion surface to the two outer side surfaces, and a plurality of engaging protrusions formed on the two outer side surfaces, wherein the inner shielding member does not protrude from the insertion surface, each of the two outer shielding members has a plurality of engaging holes, and the engaging holes of each of the two outer shielding members are respectively engaged with the engaging protrusions on the corresponding outer side surface, and wherein each of the two outer shielding members includes a plurality of positioning claws, and the positioning claws of the two outer shielding members are respectively abutted against the two guiding surfaces.

7. The high speed connector assembly according to claim 1, wherein the electrical connector includes a plurality of power terminals inserted into and fixed in the insulating housing, and the power terminals are arranged at one side of the signal terminals, and wherein the mating connector includes a plurality of mating power terminals respectively abutted against the power terminals.

8. An electrical connector of a high speed connector assembly, comprising:

an insulating housing being in an elongated shape defining a longitudinal direction, wherein the insulating housing defines an insertion direction perpendicular to the longitudinal direction; and a plurality of signal terminals inserted into and fixed in the insulating housing, wherein the signal terminals are arranged in two rows each parallel to the longitudinal direction, the signal terminals in one of the two rows respectively face the signal terminals in another one of the two rows, and each of the signal terminals includes:

a signal fixing segment engaged with an inner wall of the insulating housing; and a signal contacting segment and a signal soldering segment respectively extending from two opposite ends of the signal fixing segment, wherein the signal contacting segment has a main transmission point and a secondary transmission point, the main transmission point and the secondary transmission point are arranged along the insertion direction and are spaced apart from each other, and the main transmission point is closer to the signal fixing segment than the secondary transmission point, wherein the electrical connector includes a plurality of ground members inserted into and fixed in the insulating housing, the ground members are arranged along the longitudinal direction, and two of the ground members adjacent to each other are provided with four of the signal terminals in the two rows there-between, and wherein each of the ground members is integrally formed as a single one-piece structure and includes:

two ground terminals facing each other;

a front bridge connected to the two ground terminals; and a rear bridge connected to the two ground terminals and spaced apart from the front bridge in the insertion direction, wherein the electrical connector further includes an inner shielding member inserted into and fixed in the insulating housing, the inner shielding member is abutted against the front bridge of each of the ground members, and the signal contacting segments of two of the signal terminals facing each other are separated from each other by the inner shielding member.

* * * * *